US010222749B2

(12) United States Patent
Denden et al.

(10) Patent No.: US 10,222,749 B2
(45) Date of Patent: Mar. 5, 2019

(54) RETROGRADE TIMEPIECE DISPLAY WITH A RETRACTABLE HAND

(71) Applicant: Blancpain SA, Le Brassus (CH)

(72) Inventors: Mehdi Denden, Les Rousses (FR); Edmond Capt, Le Brassus (CH)

(73) Assignee: Blancpain SA, Le Brassus (CH)

( * ) Notice: Subject to any disclaimer, the term of this patent is extended or adjusted under 35 U.S.C. 154(b) by 84 days.

(21) Appl. No.: 15/397,219

(22) Filed: Jan. 3, 2017

(65) Prior Publication Data

US 2017/0242400 A1 Aug. 24, 2017

(30) Foreign Application Priority Data

Feb. 18, 2016 (EP) ..... 16156269

(51) Int. Cl.
*G04B 19/04* (2006.01)
*G04B 19/08* (2006.01)
*G04B 45/00* (2006.01)

(52) U.S. Cl.
CPC ..... *G04B 19/04* (2013.01); *G04B 19/042* (2013.01); *G04B 19/044* (2013.01); *G04B 19/082* (2013.01); *G04B 45/0061* (2013.01)

(58) Field of Classification Search
CPC ..... G04B 19/00; G04B 19/02; G04B 19/04; G04B 19/042; G04B 19/044; G04B 19/082; G04B 45/0061
See application file for complete search history.

(56) References Cited

U.S. PATENT DOCUMENTS 3,952,500 A * 4/1976 Tomura ..... G04B 45/0007 368/229
5,280,461 A 1/1994 Belik
7,515,508 B1 * 4/2009 Stotz ..... G04B 19/082 116/282

(Continued)

FOREIGN PATENT DOCUMENTS

CH 704 067 B1 5/2012
CH 704094 A2 * 5/2012 ..... G04B 19/02

(Continued)

OTHER PUBLICATIONS

European Search Report dated Jul. 22, 2016 in European Application 16156269, filed on Feb. 18, 2016 ( with English translation of Categories of Cited Documents & written Opinion).

*Primary Examiner* — Daniel Wicklund
(74) *Attorney, Agent, or Firm* — Oblon, McClelland, Maier & Neustadt, L.L.P.

(57) ABSTRACT

Timepiece display mechanism including a cam driven by a time base, and a pivoting lever including an elastically returned feeler member following the contour of the cam and a first rack meshing with a first angular orientation wheel which drives an indicator plate synchronously or via a differential mechanism, the indicator plate projecting radially with respect to a main axis and being parallel to or coplanar with the first wheel, the display mechanism includes a connecting rod articulated at a first end to a carriage slidably mounted on the indicator plate and carrying a retractable hand, a second end of the connecting rod being pivoted on a fixed pivot or on a movable pivot comprised in an elongation wheel set driven directly or indirectly by the lever.

19 Claims, 17 Drawing Sheets

(56) References Cited

U.S. PATENT DOCUMENTS

| | | | | |
|---|---|---|---|---|
| 2009/0185453 | A1* | 7/2009 | Wiederrecht | G04B 19/04 368/18 |
| 2010/0246341 | A1 | 9/2010 | Papi et al. | |
| 2015/0016232 | A1 | 1/2015 | Graemiger et al. | |
| 2015/0109891 | A1 | 4/2015 | Stranczl | |

FOREIGN PATENT DOCUMENTS

| | | | | | |
|---|---|---|---|---|---|
| CH | 704 696 | A2 | | 9/2012 | |
| CH | 706651 | A2 | * | 12/2013 | G04B 19/02 |
| CH | 712219 | A2 | * | 9/2017 | G04B 19/082 |
| EP | 1 491 971 | A2 | | 12/2004 | |
| EP | 2 010 971 | B1 | | 11/2010 | |
| EP | 2 824 521 | A2 | | 1/2015 | |
| EP | 2 863 274 | A1 | | 4/2015 | |
| EP | 3070538 | A1 | * | 9/2016 | G04B 19/02 |
| JP | 2005140725 | A | * | 6/2005 | |
| JP | 2015007539 | A | * | 1/2015 | G04B 19/02 |
| JP | 2015007540 | A | * | 1/2015 | G04B 19/02 |
| WO | WO 2007/110451 | A2 | | 10/2007 | |

* cited by examiner

RETROGRADE TIMEPIECE DISPLAY WITH A RETRACTABLE HAND

This application claims priority from European Patent Application No 16156269.9 of Feb. 18, 2016, the entire disclosure of which is hereby incorporated herein by reference.

FIELD OF THE INVENTION

The invention concerns a timepiece display mechanism including a cam driven by a time base, a pivoting lever including an elastically returned feeler member following the contour of the cam, and a first rack meshing with a first angular orientation wheel which drives an indicator plate synchronously or via a differential mechanism, this indicator plate projecting radially with respect to a main axis and being parallel to or coplanar with the first wheel.

The invention also concerns a timepiece movement including at least one display mechanism of this type.

The invention concerns a watch including such a timepiece movement and/or including at least one such display mechanism.

The invention concerns the field of timepiece display mechanisms.

BACKGROUND OF THE INVENTION

The space available on watch dials does not always make it possible to achieve displays in the best conditions for legibility, especially when the watch cases are small, and/or of non-circular shape. This difficulty is amplified where multiple complications are present in the movement, creating a conflict between the display areas.

Controlling a display member, particularly a hand, over a required trajectory, which is other than circular, often results in the use of milled cams, in a substantial thickness, and in a lack of versatility and difficulty in adapting the mechanism for a display with a different trajectory. Known articulated hand mechanisms do not permit easy adjustment of the orientation and reference elongation of the hands. These complications also require highly qualified operators.

SUMMARY OF THE INVENTION

The invention proposes to create a display with a retractable display member, notably a retractable hand, and in particular according to the angular position of a support for the display member, such as the body of a hand or similar.

The invention concerns a timepiece display mechanism according to claim 1.

The invention also concerns a timepiece movement including at least one display mechanism of this type.

The invention concerns a watch including such a timepiece movement and/or including at least one such display mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
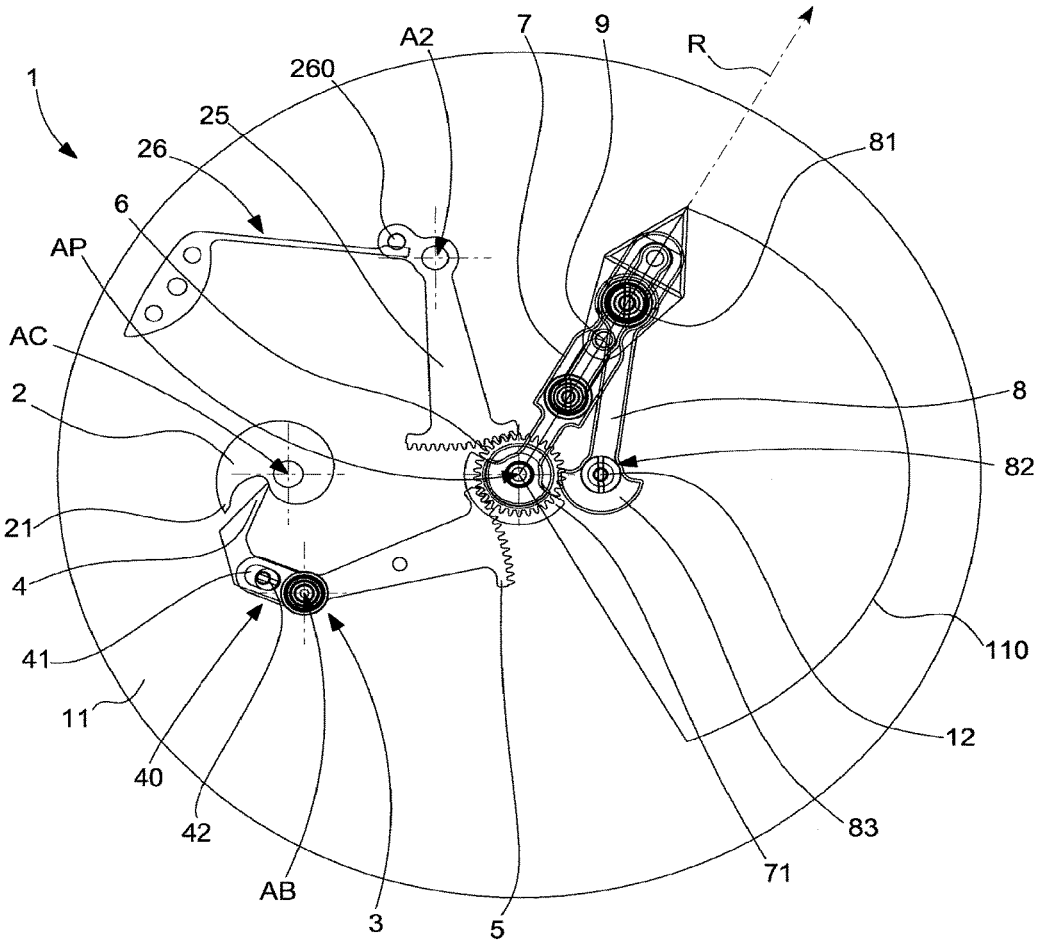
FIGS. 1 to 5 represent schematic plan views of the same display mechanism according to a first embodiment of the invention, in five successive time steps between an initial state and a final state, including an elongation and then a contraction of the hand.

The invention proposes to create a display with a retractable display member, notably a retractable hand, and in particular according to the angular position of a support for the display member, such as the body of a hand or similar. It is described here in the particular and non-limiting case of a hand.

This display is uncommon. Indeed, the hand extends and retracts during its travel, thereby allowing it to have a curvilinear path, notably an elliptical path in the variants illustrated by the Figures, instead of following circular arc. This configuration makes it possible to adapt the trajectory of the hand to the shape of the dial of the case, which provides good legibility, and also an innovative and distinctive aesthetic effect. To achieve this, the invention implements a connecting rod/crank mechanism, which, in a particular application, is combined with a retrograde system.

The invention concerns a timepiece display mechanism 1 which includes, arranged on a bridge 11, a cam 2 arranged to be driven by a time base comprised in a timepiece movement 100, at an output 101, and a lever 3.

This lever 3 is mounted to pivot about a lever axis AB, it includes, on the one hand, a feeler member 4 which follows the contour of cam 2 under the action of elastic return means, and on the other hand, a first rack 5 in a circular arc about lever axis AB.

Figure 15:
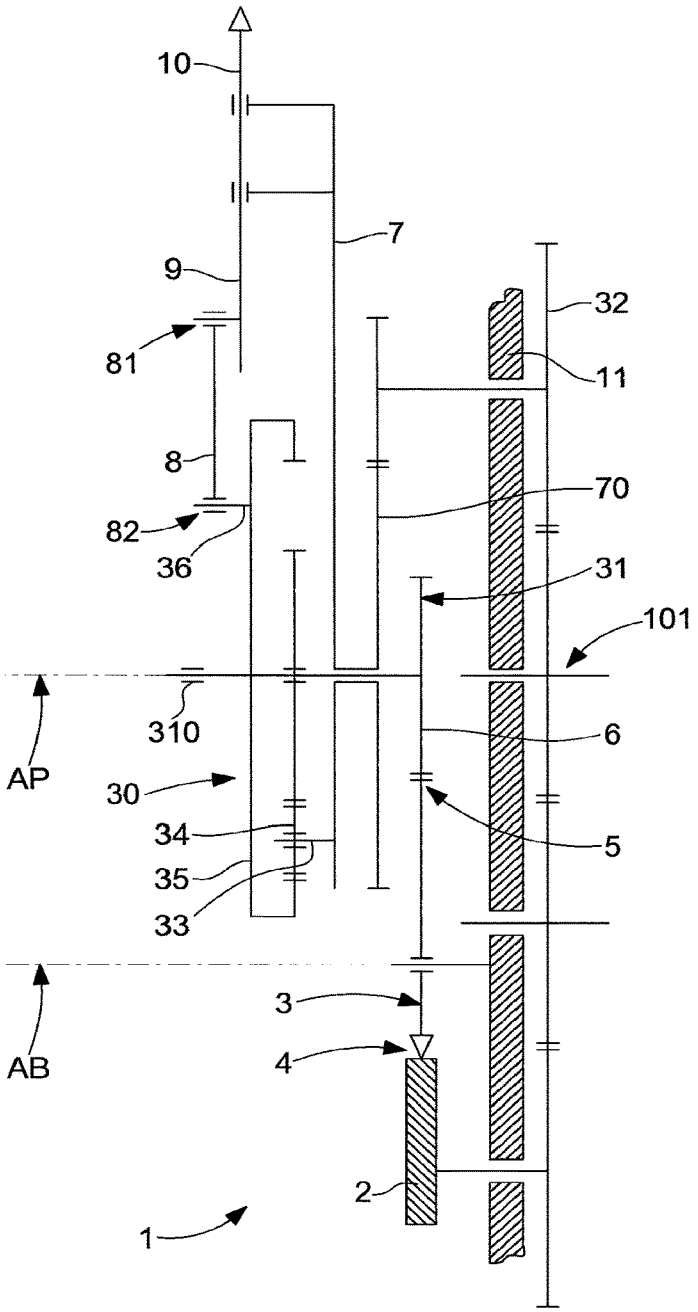
FIG. 15 represents a schematic cross-sectional view of a third embodiment of the invention.
Figure 16:
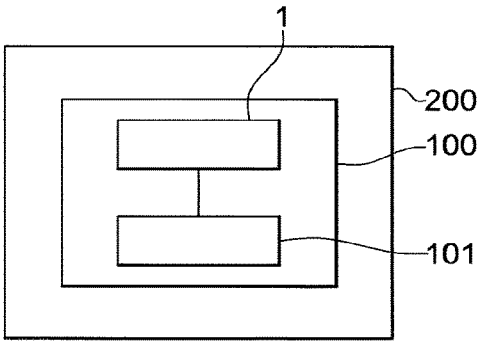
FIG. 16 is a block diagram representing a watch including a movement which in turn includes a display mechanism according to the invention.

Display mechanism 1 also includes a first angular orientation wheel 6, which directly or indirectly drives an indicator plate 7. First rack 5 meshes with this first angular orientation wheel 6 to drive it in rotation about a first axis Al. First angular orientation wheel 6 drives indicator plate 7, either synchronously, as seen in the first and the second embodiment respectively illustrated in FIGS. 1 to 7 and 8 to 14, or via a differential mechanism 30, as seen in FIG. 15 in a third embodiment.

Indicator plate 7 projects radially with respect to a main axis AP, and is parallel to or coplanar with first wheel 6. More particularly, first axis A1 and main axis AP are coincident.

According to the invention, display mechanism 1 includes a connecting rod 8, which is articulated at a first end 81 to a carriage 9, slidably mounted on indicator plate 7, and said carriage 9 preferably carries a retractable hand 10, or constitutes such a hand, or a display member of another shape. A second end 82 of connecting rod 8 is pivoted, either on a fixed pivot 12 on bridge 11 in the case of the first embodiment, or on a movable pivot comprised in an elongation wheel set driven directly or indirectly by lever 3, in the second and third embodiments.

In the first embodiment of FIGS. 1 to 7, first angular orientation wheel 6 synchronously drives indicator plate 7, directly or via a gear train, and the second end of connecting rod 8 is pivoted on a fixed pivot 12 on bridge 11.

In a particular variant, as illustrated in FIGS. 1 to 14, display mechanism 1 is a retrograde display mechanism.

In a particular embodiment, cam 2 is a snail cam including, on its maximum radius, a beak 21, the passage of which causes feeler member 4 to jump back onto the minimum radius of cam 2. Display mechanism 1 also includes, pivoted on bridge 11, a third rack 25, which is returned by primary elastic return means 26, and which meshes with first angular orientation wheel 6 to take up play upon its retrograde return when feeler member 4 jumps back onto the minimum radius of cam 2.

It is clear that the cam profile is adapted to the trajectory that is desired to be achieved, the above example being intended for a retrograde display in a given angular sector. Naturally, other profiles can be achieved, for other trajectories, for example, a heart-piece that produces an elliptical return trajectory at the same speed, or other.

Preferably, to avoid unbalances, indicator plate 7 includes at least a first counterweight 71, which is arranged to balance, with respect to main axis AP, the assembly formed by indicator plate 7, with the carriage 9 at the midpoint of the latter's travel, and with retractable hand 10.

In the non-limiting variant illustrated by the Figures, and regarding an elliptical trajectory of the end of hand 10, cam 2 rotates clockwise. In rotating, cam 2 raises first rack 5, which is forced against cam 2 by a return spring (not represented). Indicator plate 7 is here, in a non-limiting manner, integral with first angular orientation wheel 6, and is thus driven by first rack 5. In rotating with respect to main axis AP, indicator plate 7 pushes connecting rod 8 at its first end 81 via an articulation arbor. Carriage 9 is connected to two arbors that can slide over indicator plate 7, one of which is the articulation arbor of connecting rod 8. The centre of rotation of connecting rod 8, at its second end 82, is located at fixed pivot 12, and is thus different from that of indicator plate 7. Connecting rod 8 therefore pushes or pulls the articulation arbor located at its first end 81, which drives carriage 9, respectively for the elongation or retraction of hand 10. Hand 10 therefore slides, to extend or retract, while pivoting with respect to main axis AP.

The kinematic of FIGS. 1 to 5 describes a succession of intermediate positions, in a retrograde variant, where the end of hand 10 follows the elliptical edge of an aperture 110:

FIG. 1 shows the initial position, of maximum retraction of the hand assembly, immediately after the jump of feeler member 4 from beak 21 onto the surface of minimum radius of cam 2.

Figure 2:
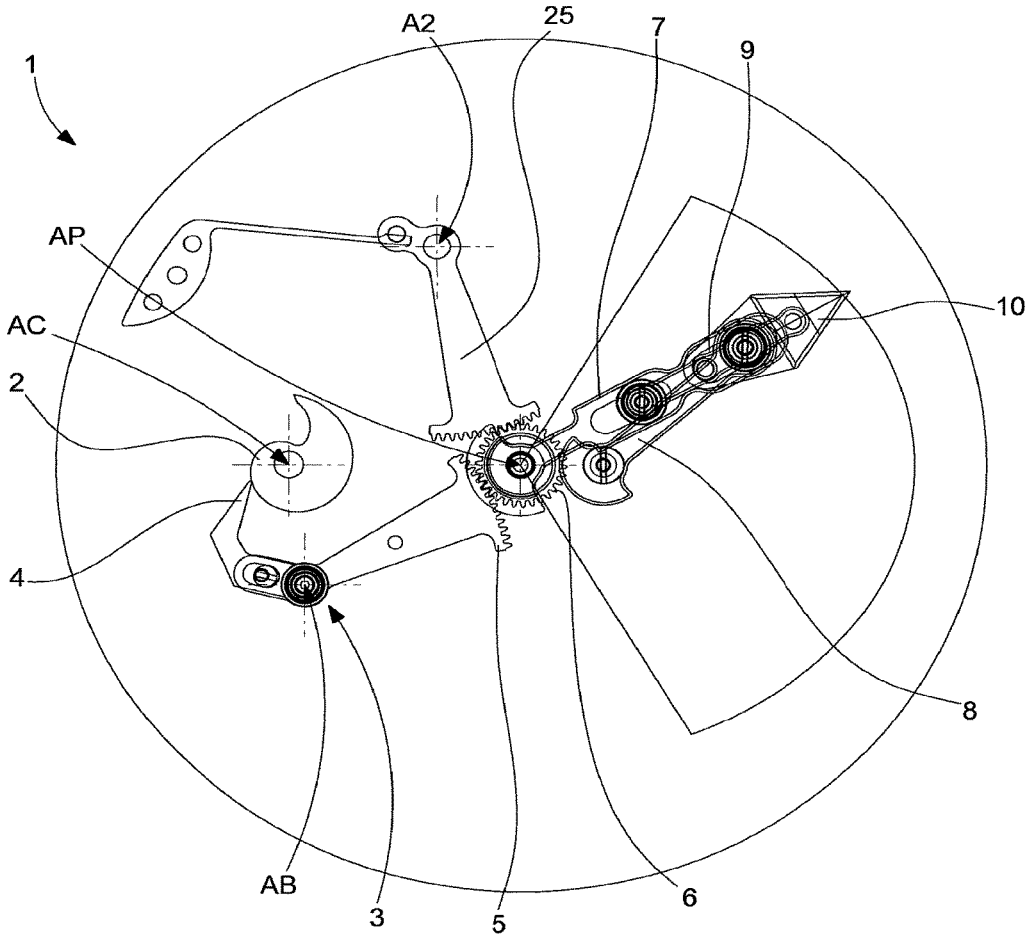

FIG. 2 shows the elongation of the hand assembly after a 30° rotation of indicator plate 7.

Figure 3:
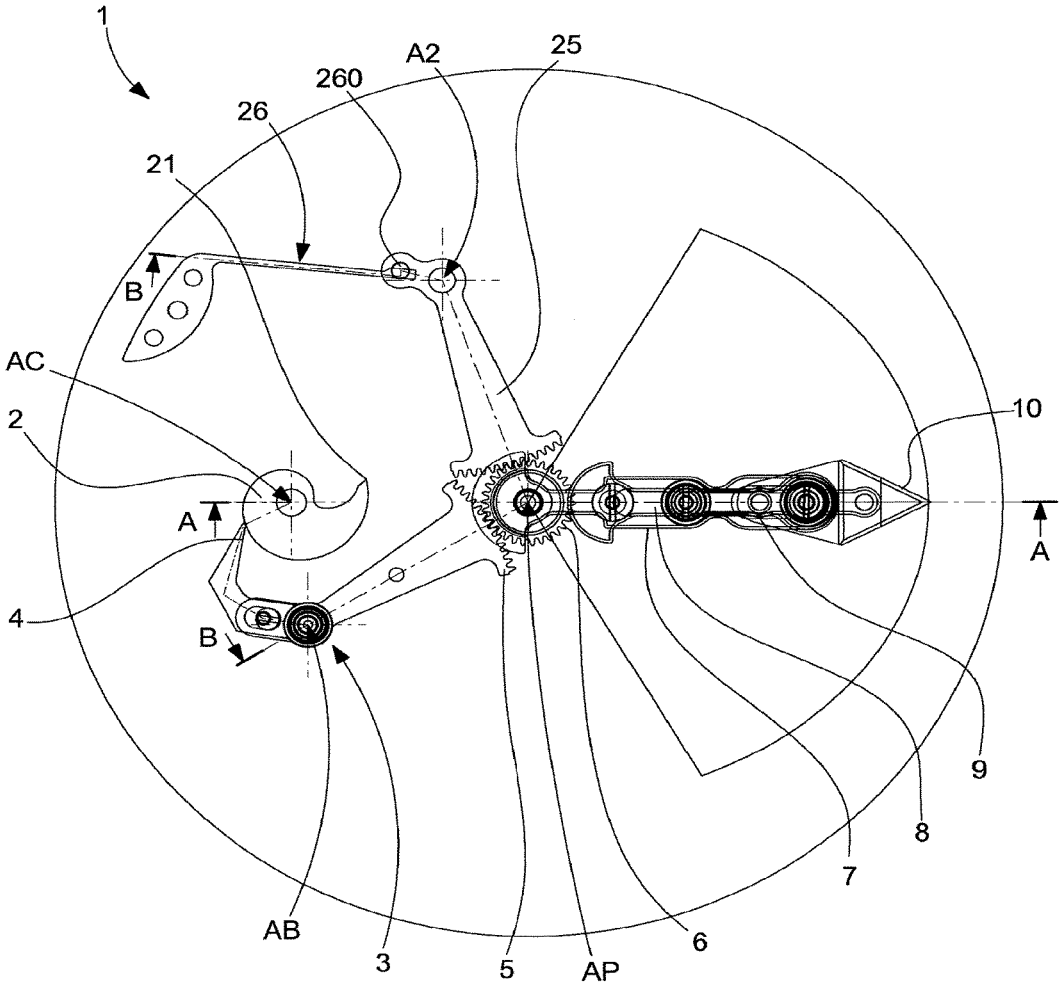

FIG. 3 shows the maximum elongation of the hand assembly, in mid angular travel.

Figure 4:
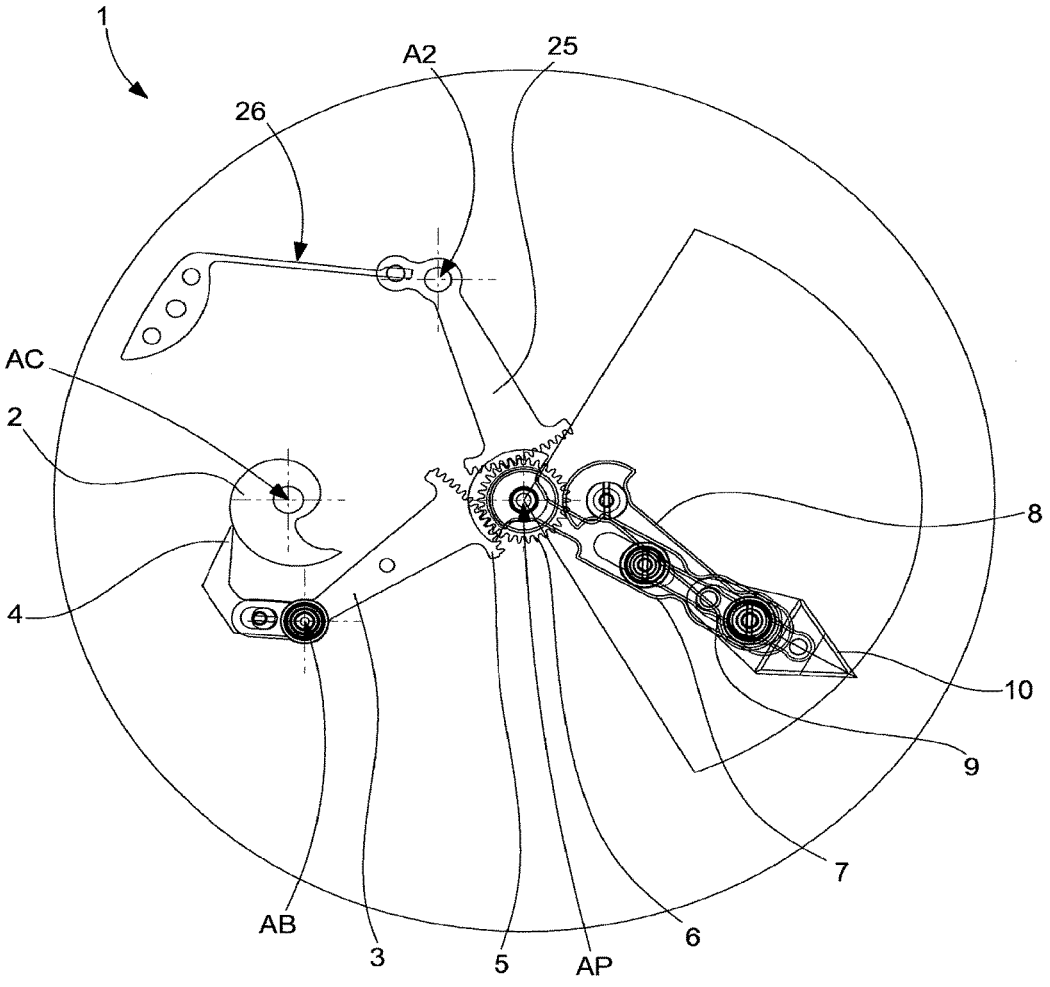

FIG. 4 shows the retraction of the hand assembly after a 90° rotation of indicator plate 7.

Figure 5:
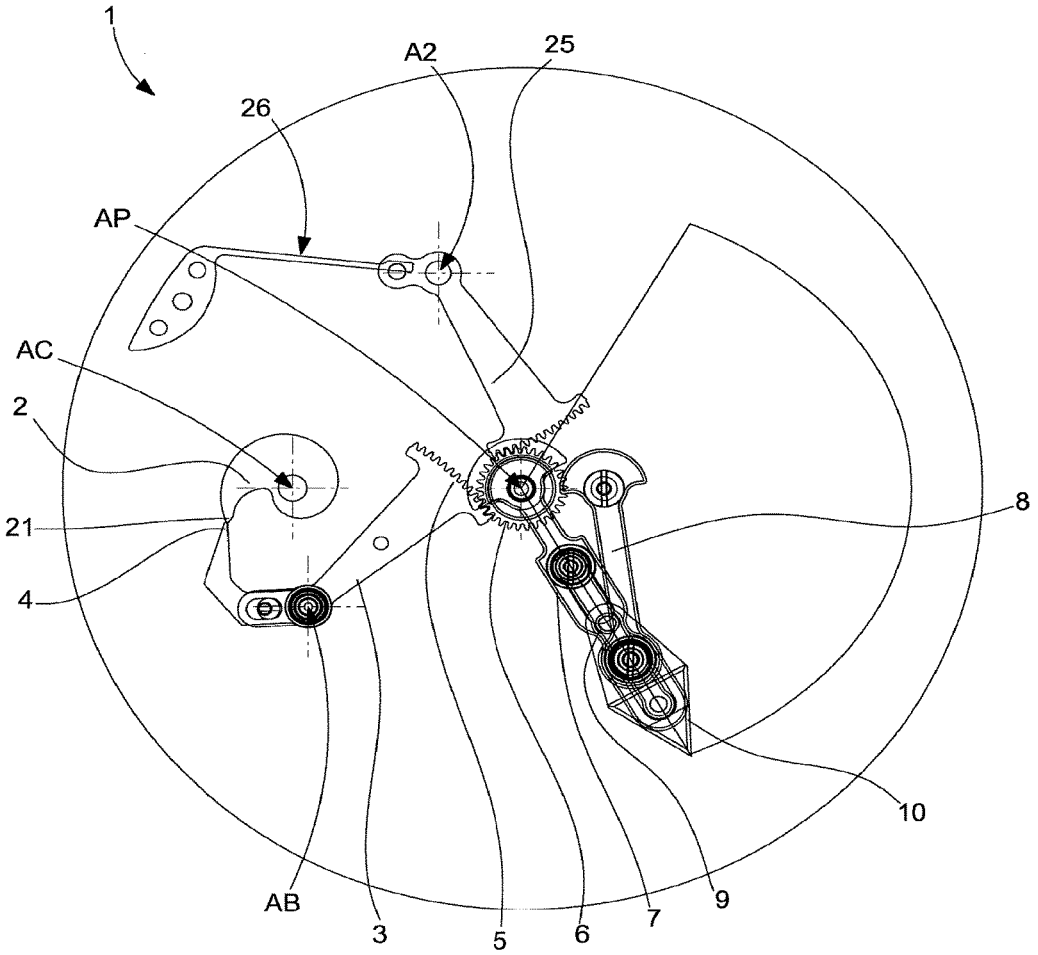
Figure 6:
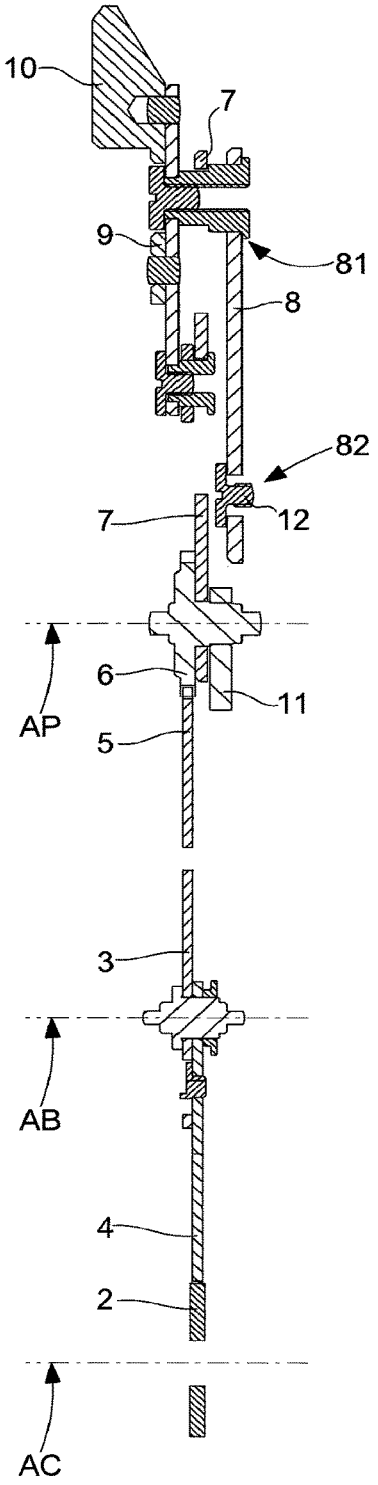
FIGS. 6 and 7 represent schematic cross-sectional views of the display mechanism of FIGS. 1 to 5, along sectional lines AA and BB seen in FIG. 3.
Figure 7:
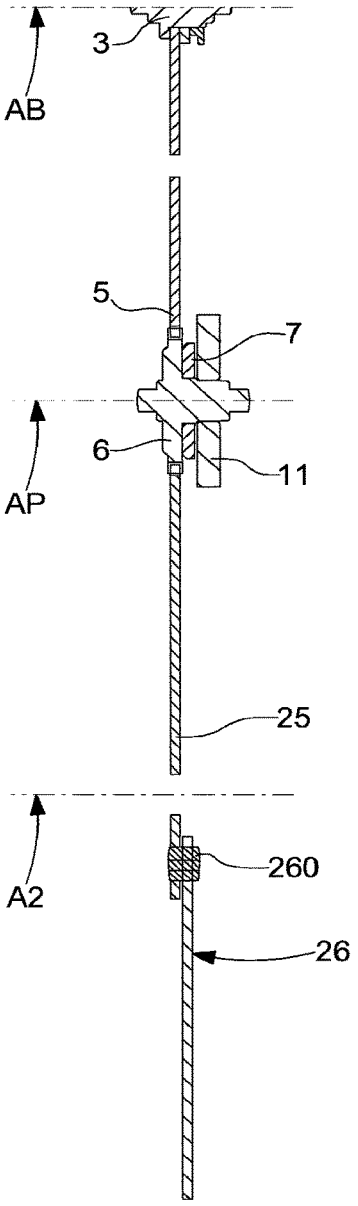

FIG. 5 shows the final position, of maximum retraction of the hand assembly, when feeler member 4 is on the surface of maximum radius of cam 2, at beak 21, immediately before the jump of feeler member 4.

In the second embodiment of FIGS. 8 to 14, first angular orientation wheel 6 synchronously drives indicator plate 7, directly or via a gear train, and lever 3 carries, parallel to first rack 5, a second rack 15 which meshes with a second elongation wheel 16 also comprised in display mechanism 1. This second elongation wheel 16 is synchronous with a lever element 18 forming such an elongation wheel set, and which carries a lever pivot 13 forming the moving articulation pivot for connecting rod 8, second wheel 16 are being parallel to or coplanar with lever element 18. More particularly, second wheel 16 is integral with lever element 18.

In this second embodiment, display mechanism 1 also includes, pivoted on bridge 11, a fourth rack 27 returned by secondary elastic return means 28, which may be coincident with primary elastic return means 26, as in the case of FIGS. 8 to 14, and this fourth rack 27 meshes with second elongation wheel 16 to take up play upon its retrograde return when feeler member 4 jumps back onto the minimum radius of cam 2.

Preferably, to avoid unbalances, in the second embodiment, the elongation wheel set preferably includes at least a second counterweight 72, which is arranged to balance, with respect to main axis AP, the assembly formed by lever 1 element 8 with moving pivot 13 and with connecting rod 8.

The kinematic is similar to that of the first embodiment, but this time the second end 82 of connecting rod 8 is pivoted on a movable point, which is carried by lever element 18.

Cam 2 rotates clockwise. In rotating, cam 2 raises first rack 5, which is forced against cam 2 by a return spring (not represented). Indicator plate 7 is integral with first angular orientation wheel 6, and is thus driven by first rack 5. Second rack 15, which is integral with first rack 5, drives second elongation wheel 16, which in turn drives connecting rod 8 via lever element 18 integral with second elongation wheel 16. Carriage 9 is connected to two arbors that can slide over indicator plate 7. Carriage 9 and lever element 18 do not rotate at the same speed, due to the different gear ratio, indicator plate 7 thus pushes connecting rod 8 at its first end via the arbor, pushing or pulling this arbor and thereby carriage 9. Hand 10 thus slides, to extend or retract, while pivoting with respect to main axis AP.

Figure 8:
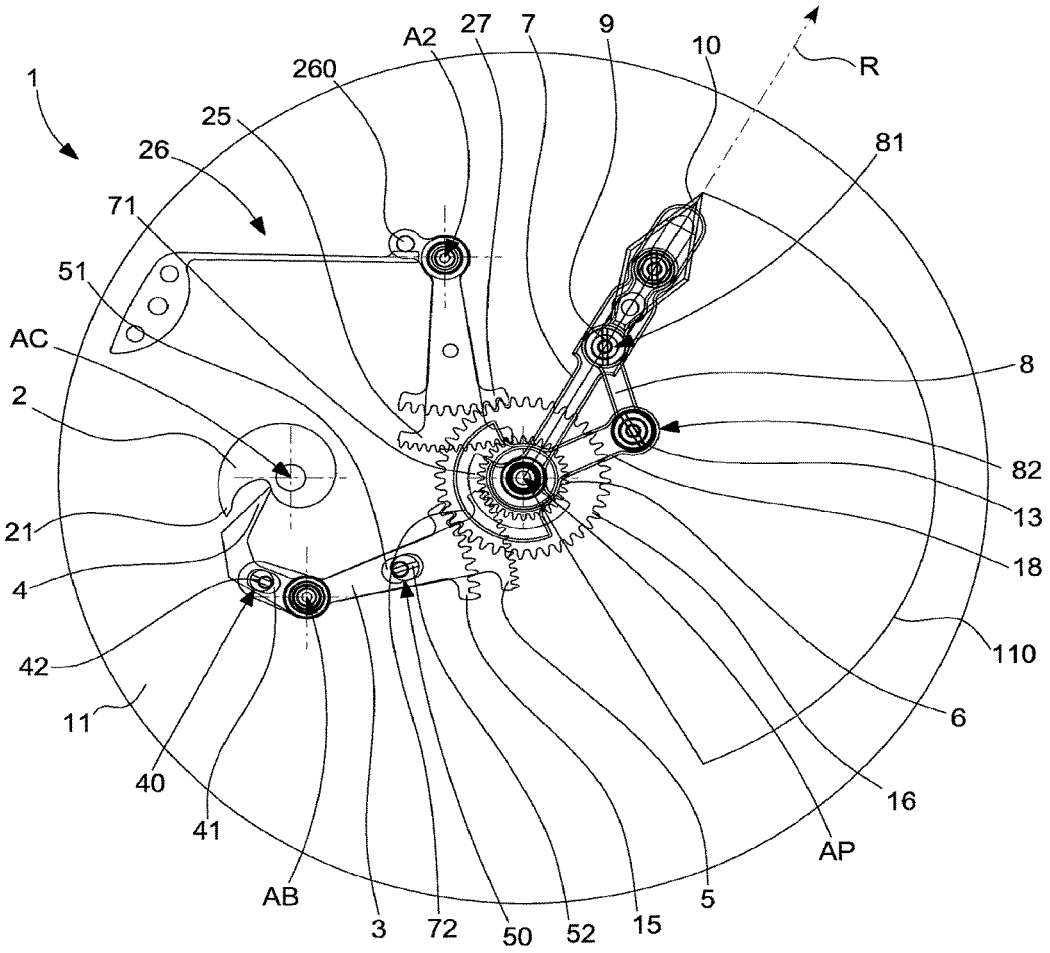
FIGS. 8 to 12 represent schematic plan views of the same display mechanism according to a second embodiment of the invention, in five successive time steps between an initial state and a final state, including an elongation and then a contraction of the hand.

The kinematic of FIGS. 8 to 12 describes a succession of intermediate positions, in a retrograde variant, where the end of hand 10 follows the elliptical edge of an aperture 110:

FIG. 8 shows the initial position, of maximum retraction of the hand assembly, immediately after the jump of feeler member 4 from beak 21 onto the surface of minimum radius of cam 2.

Figure 9:
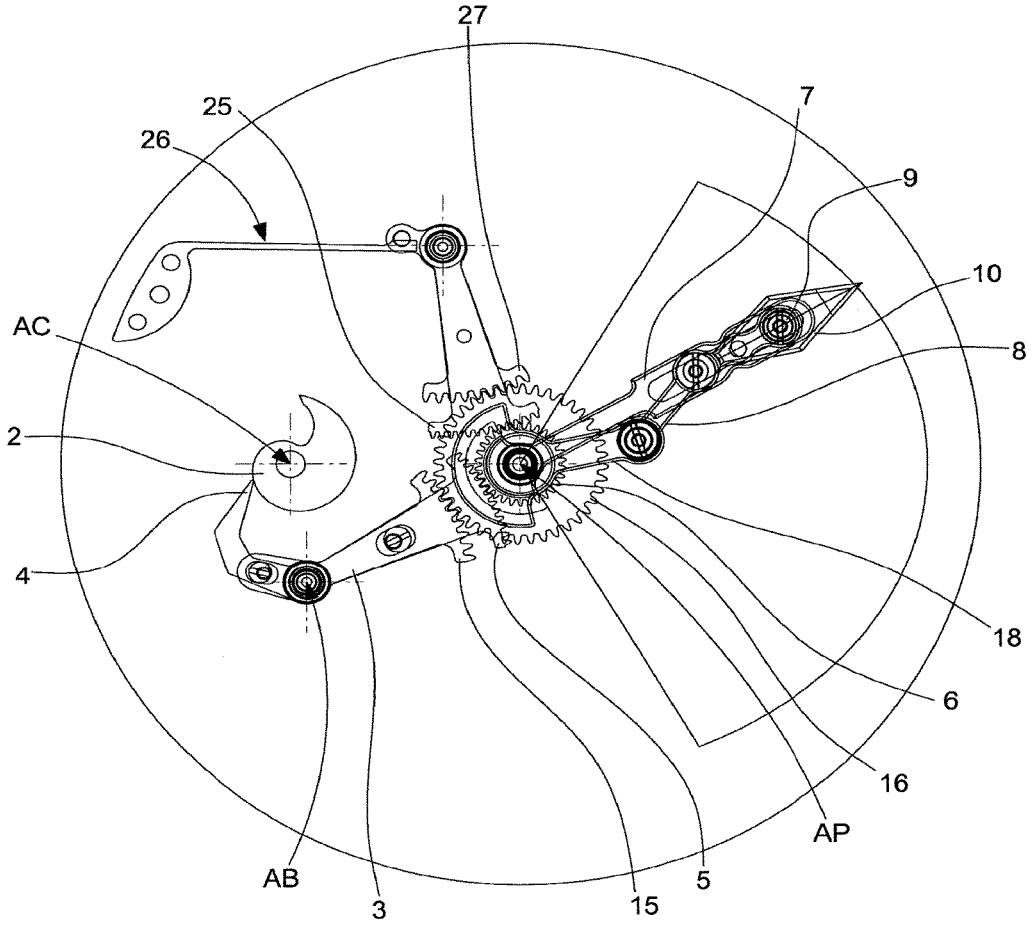

FIG. 9 shows the elongation of the hand assembly after a 30° rotation of indicator plate 7.

Figure 10:
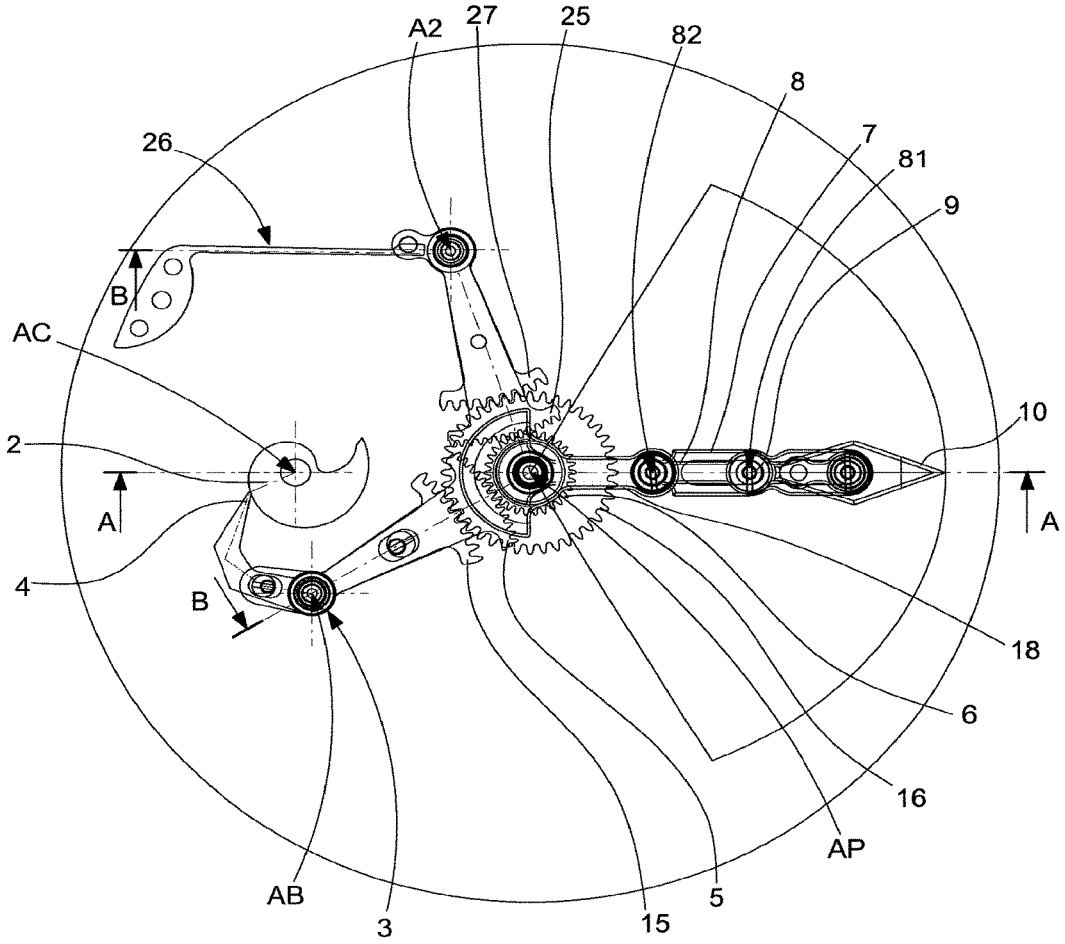

FIG. 10 shows the maximum elongation of the hand assembly, in mid angular travel.

Figure 11:
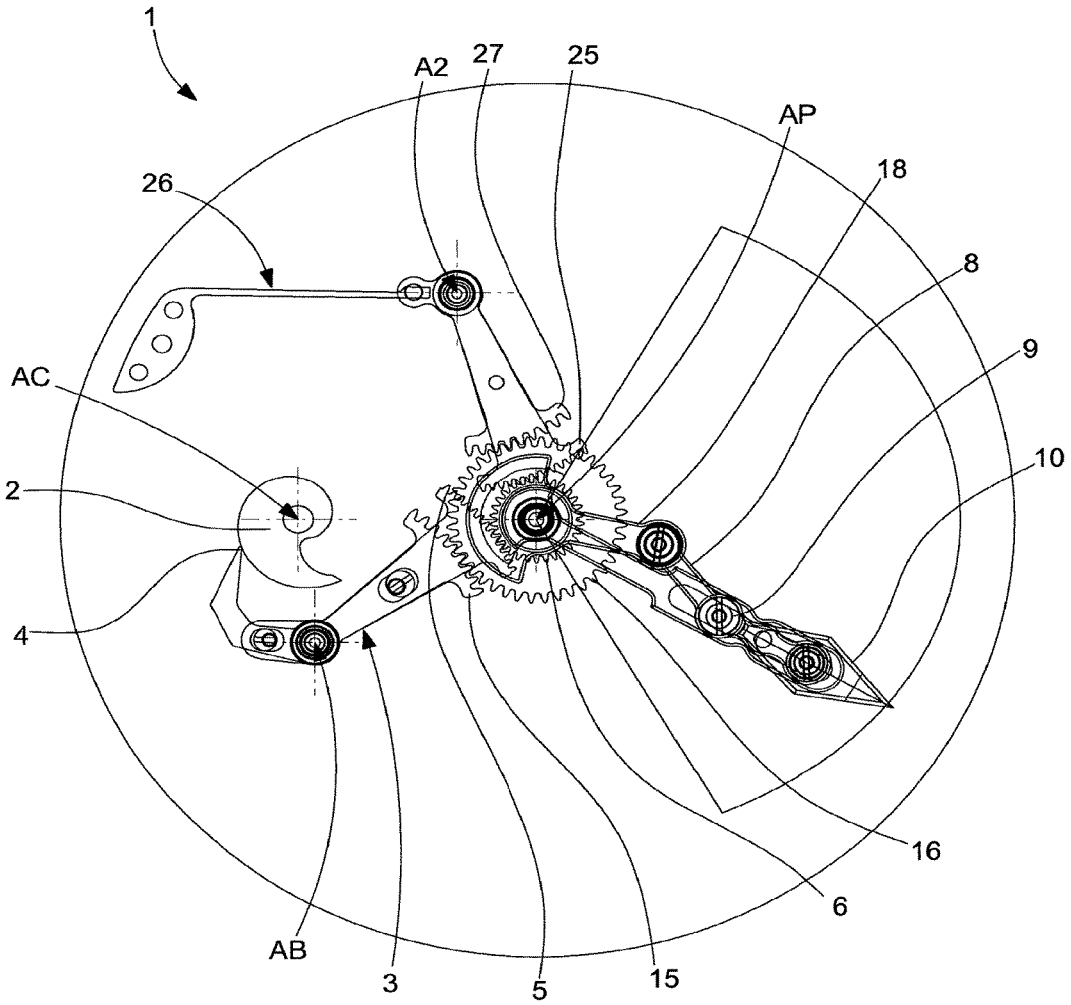

FIG. 11 shows the retraction of the hand assembly after *a* 90° rotation of indicator plate 7.

Figure 12:
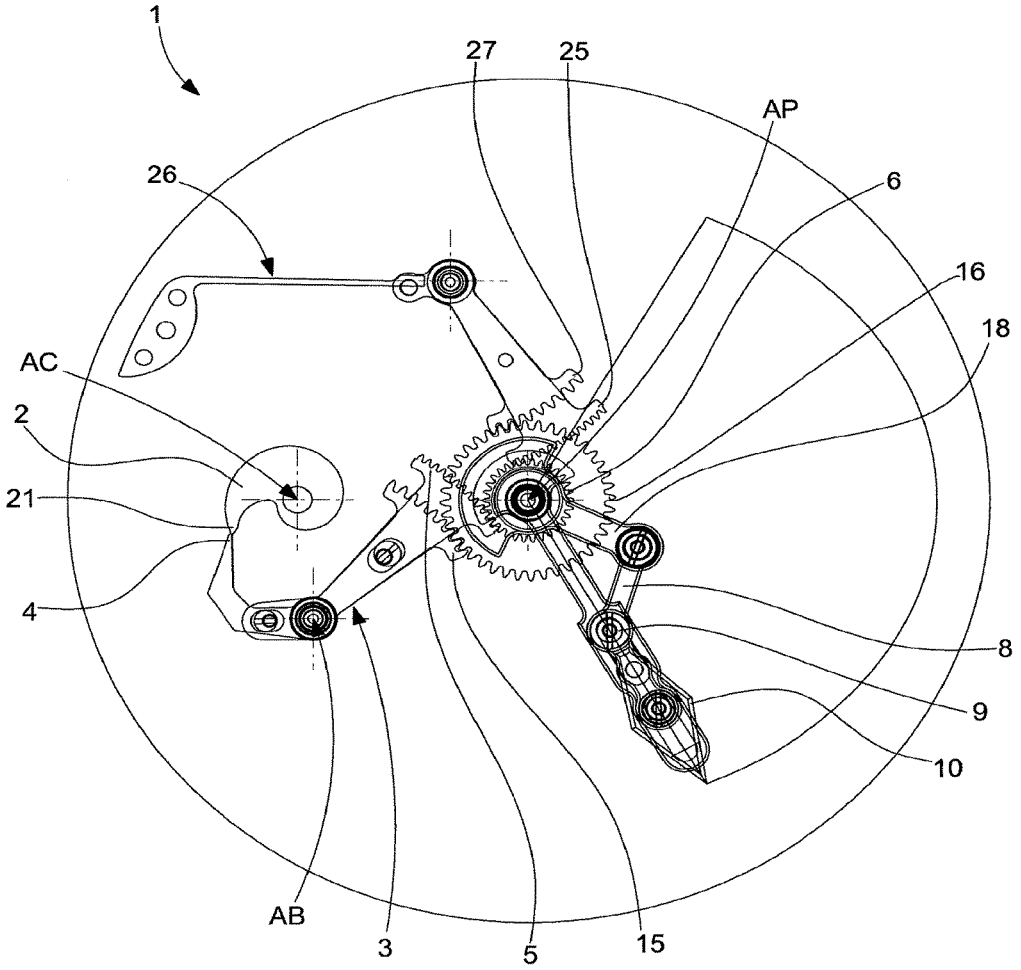
Figure 13:
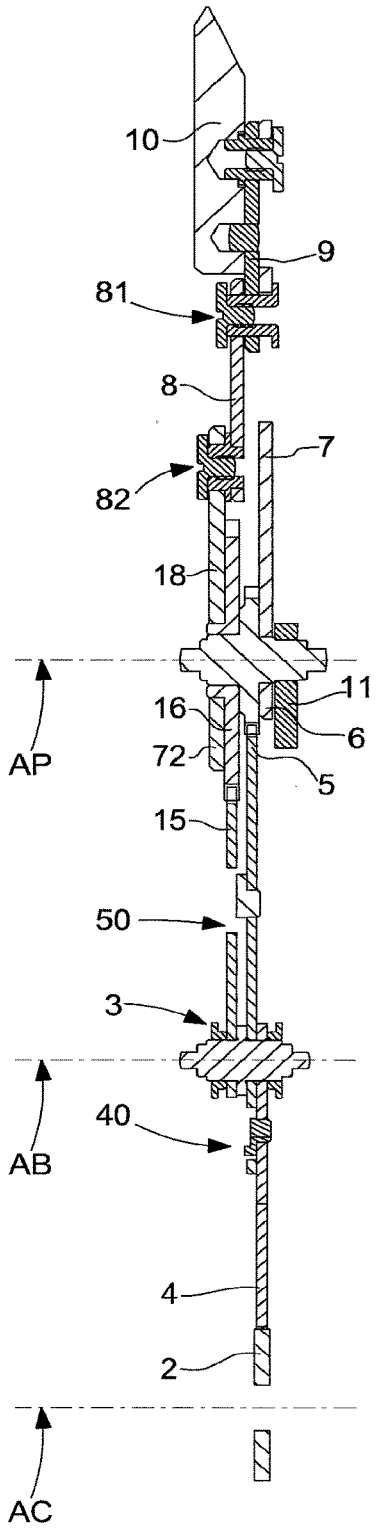
FIGS. 13 and 14 represent schematic cross-sectional views of the display mechanism of FIGS. 8 to 12, along sectional lines AA and BB seen in FIG. 10.
Figure 14:
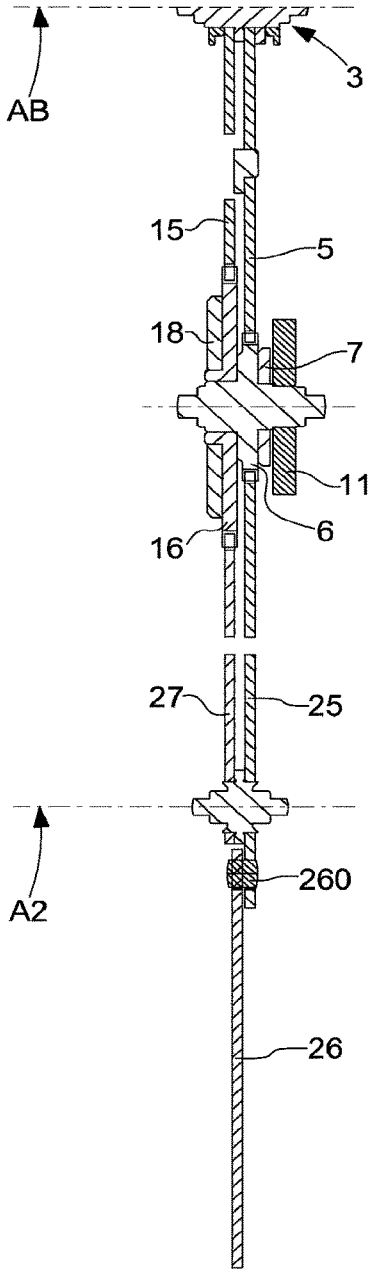

FIG. 12 shows the final position, of maximum retraction of the hand assembly, when feeler member 4 is on the surface of maximum radius of cam beak 21, immediately before the jump of feeler member 4.

Likewise, in each of the embodiments described here, connecting rod 8 preferably includes a third balancing counterweight 83.

A third embodiment uses a differential capable of controlling several speeds. It is a differential mechanism with a connecting rod articulated on a differential cage, wherein the combination of two inputs, which are each powered by a rack following a cam or by the movement, allows the tip of the hand to follow any geometric trajectory imposed by the profile and the rotational speed of the cam. Indeed, if, for example, the cam is oval and rotates at the same speed as the hand, the hand follows an elliptical trajectory; if the cam rotates at a speed that is an integer multiple of that of the hand, a multilobed trajectory of the hand is obtained.

Associated with the double rack system, this differential can display a large variety of geometrical trajectories. The first input of the differential is directly connected to the movement (one revolution per hour for a minute display, one revolution per 12 hours for an hour display, etc . . . ). The second input is connected to a rack that follows a cam. The differential output adds the speeds from the two inputs and rotates the connecting rod. Finally, the elongation of the hand depends directly on the shape of the cam. For example, a heart-shaped cam allows the hand to follow an oval: as the cam rises, the connecting rod moves more quickly than the plate over 180°, elongation and retraction of the hand over 180°; then the descent of the cam where the connecting rod moves more slowly than the plate over 180° and returns to its initial position, elongation and retraction of the hand over 180°.

The differential is thus controlled by two cams, one for elongation and the other for advancement. This mechanism can control an articulated arm, with great freedom of design.

The choice of a suitable cam profile allows a particular geometrical path to be obtained: elliptical, square, rectangular or other.

More particularly, as represented in FIG. 15, this third embodiment concerns such a differential mechanism, wherein first angular orientation wheel 6 meshes with a first wheel set 31, which forms a first input of differential mechanism 30, or actually forms the first wheel set 31, as in this particular case.

Display mechanism 1 includes a second wheel set 32, which, directly or indirectly driven by an output 101 of movement 100, or formed by such an output 101, is synchronous with cam 2, and which drives indicator plate 7.

Indicator plate 7 forms a second input of differential mechanism 30.

Differential mechanism 30 includes, in a conventional manner, a differential cage 35, forming such an elongation wheel set, and which carries a cage pivot 36, forming the movable articulation pivot for connecting rod 8.

Indicator plate 7 includes at least one planetary pivot 33, which carries a planetary wheel 34 meshing both with differential cage 35 and first wheel set 31, guided here in a guide 310 of bridge 11 or of another component of the structure of movement 100.

When a particular guide 31, for example cantilevered from below, makes it possible to free the upper surface of differential cage 35, there is nothing to prevent the free rotation of connecting rod 8, which then does not interfere with any arbors, and a 360° display is possible. The variant of FIG. 15 includes a portion of an arbor of first wheel set 31 capable of colliding with connecting rod 8, which requires the choice of a retrograde mechanism as described in detail for the first and second embodiments.

This differential mechanism may have many variants. In particular, it is possible to block differential cage 35, to return to an equivalent of the first embodiment, which naturally requires a retrograde display. Another variant consists in replacing second wheel set 32 with a rack, meshed on a plate wheel 70 integral with indicator plate 7, and which follows a cam driven by the movement.

It is understood that, under some conditions of passage of the components, the third embodiment with a differential makes it possible to obtain rotation of the hand over 360°, first retrograde rack 5 of the first and second embodiments is then no longer necessary and only second elongation rack 15 of the second embodiment is retained.

In the various embodiments illustrated, in a particular and non-limiting manner, carriage 9 is movable in a radial direction R with respect to main axis AP, as seen in the Figures.

In a particular embodiment illustrated by FIGS. 1 to 14, first rack 5 is angularly adjustable, with reference to lever axis AB, with respect to feeler member 4. A first adjustment device 40 notably includes an eccentric screw 42 cooperating with an oblong hole 41.

In a particular embodiment illustrated by FIGS. 8 to 14, second elongation wheel 16 pivots about main axis AP.

In a particular variant of the second embodiment, illustrated in FIGS. 8 to 14, first rack 5 and second rack 15 have different radii with respect to lever axis AB. More particularly, second rack 15 has a smaller radius than that of first rack 5.

In a particular embodiment illustrated by FIGS. 8 to 14, second rack 15 is angularly adjustable, with respect to lever axis AB, with respect to first rack 5. A first adjustment device 50 notably includes an eccentric screw 52 cooperating with an oblong hole 51.

FIGS. 17 to 24 illustrate other particular embodiments according to the invention.

Figure 17:
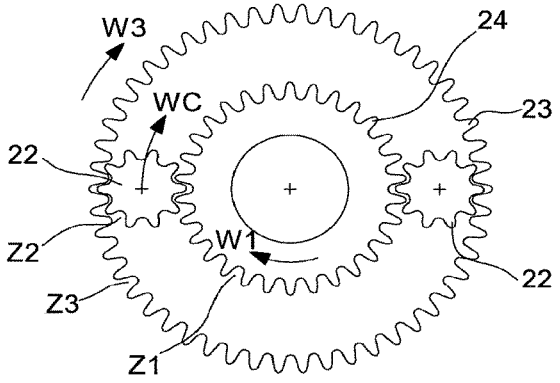
FIG. 17 a schematic diagram of the differential used in the third embodiment of the invention, and whose inputs are controlled by two cams, one for elongation of the hand, and the other for advancement of the latter.

FIG. 17 is a schematic view of a differential, whose output is a connecting rod/crank system, for controlling the extension of an arm, or of a hand, over 360°. Two planetary wheels 22, having a number of teeth Z2, are movable, with an angular velocity Wc, between an external toothed transmission wheel 23, having a number of teeth Z3, and of angular velocity W3, and an inner wheel 23, having a number of teeth Z1, and of angular velocity W1. The equation connecting the velocities W1, W2 and W3 of this differential is as follows:

$$W1.\ Z1+W3.\ Z3=Wc.\ (Z1+Z3)$$

In a given time base, this formula is equivalent to:

$$\theta 1=\theta c.\ (Z1+Z3)/Z1-\theta 3.\ Z3/Z1, \text{ with:}$$

the angle of advancement of the arm which is equal to θc. (Z1+Z3)/Z1, and the angle between the connecting rod and the arm which is equal to θ3. Z3/Z1, then θ1 is the angle that the connecting rod has to travel to move closer to or away from the rotating arm. In other words, θ1 makes it possible to control the elongation of a hand that is rotating at a velocity Wc. (Z1+Z3)/Z1.

Figure 18:
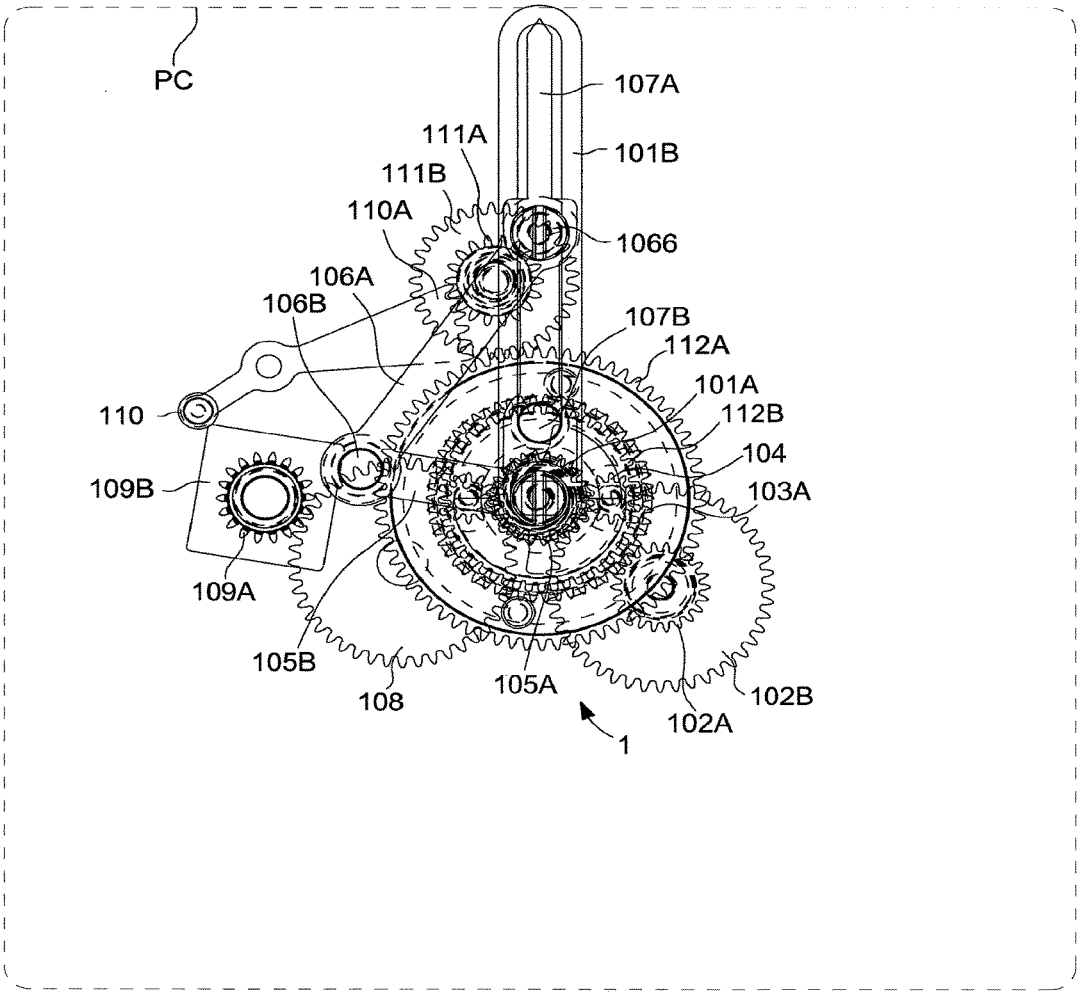
FIGS. 18 to 20 illustrate, in plan cross-sectional views, a square display.
Figure 19:
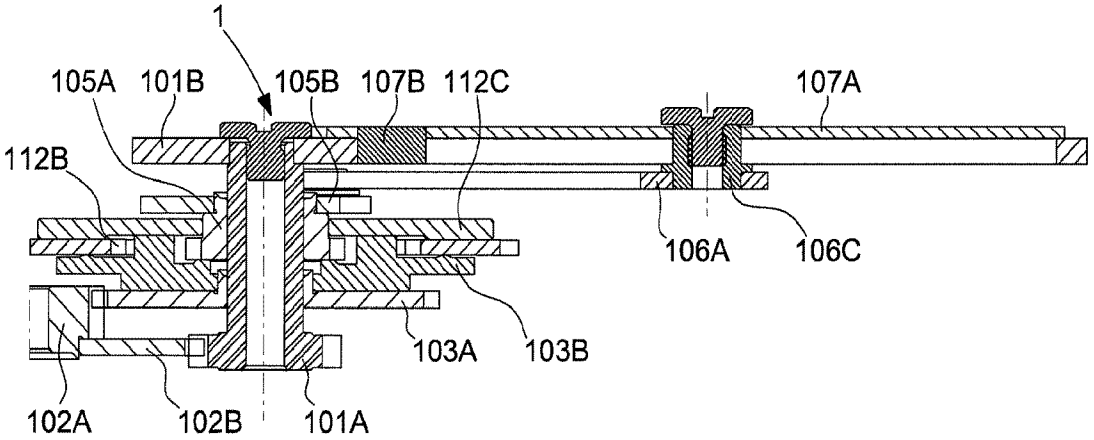
Figure 20:
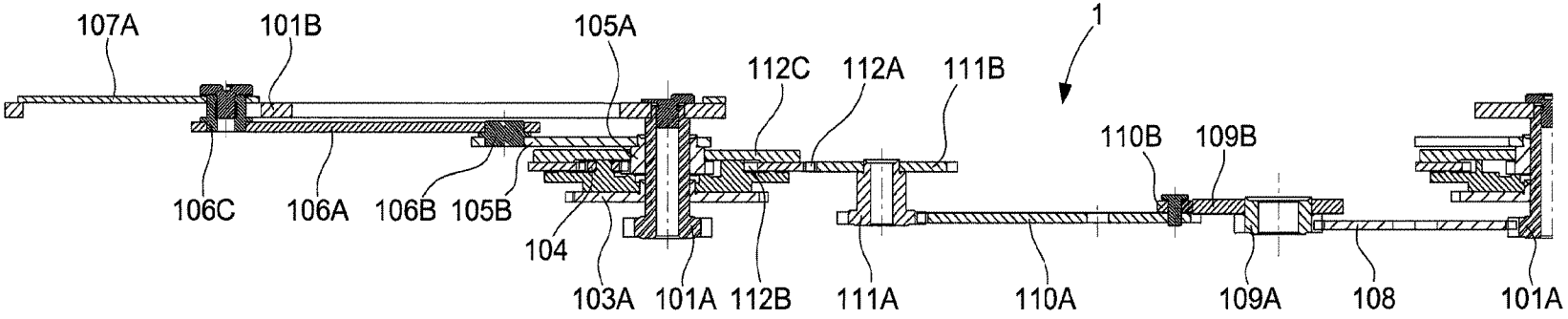

FIGS. 18 to 20 illustrate a square display. Components similar to those of the embodiments of FIGS. 1 to 17 bear the same numeral, added to the value 100.

The first differential input 103A is connected to the cannon-pinion 101A. This input rotates continuously, and is powered by the movement at a velocity of one revolution per hour, in the particular and non-limiting illustrated example.

The second differential input 112A is connected to a rack 110A whose roller 110B follows the profile of cam 109B which is rotated by cannon-pinion 101A.

Connecting rod 106A pivots on arbor 106B which is pressed into lever element 105B.

Connecting rod 106A acts on hand 107A via arbor 106C. This arbor 106C slides on arm 101B, which is screwed onto cannon-pinion 101A.

Given that the output velocity of lever element 105B is the sum of the rotational velocity of cannon-pinion 101A and of rack 110A which picks up information from cam 109B, the angle, and therefore the elongation of the hand, between lever element 105B and arm 101B, is directly related to the profile of cam 109B.

In the illustrated example, a square cam allows the tip of the hand to follow a square travel PC. A heart-piece would make it possible to obtain a heart-shaped travel and the shape of any cam can therefore be reproduced.

This mechanism is not limited to the particular display of the minutes or hours. Indeed, it is, for example, possible to have an arm that indicates the hour, and a small cursor that slides inside the hand thus displaying the power reserve of the movement within the hour hand.

Figure 21:
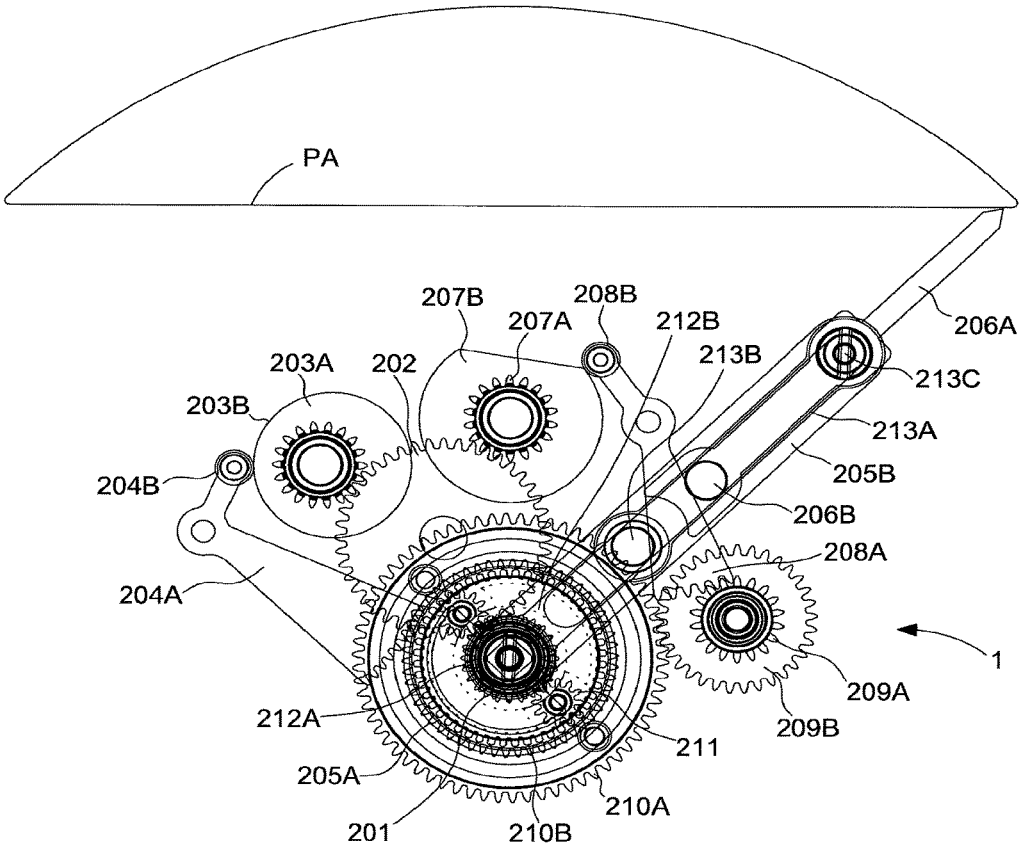
FIGS. 21 to 23 illustrate, in plan cross-sectional views, a display with an articulated arm.
Figure 22:
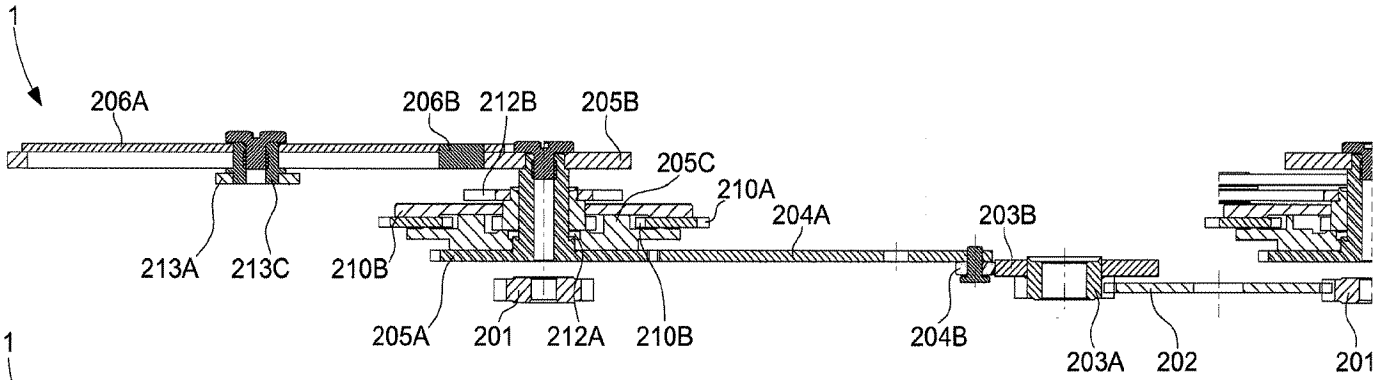
Figure 23:
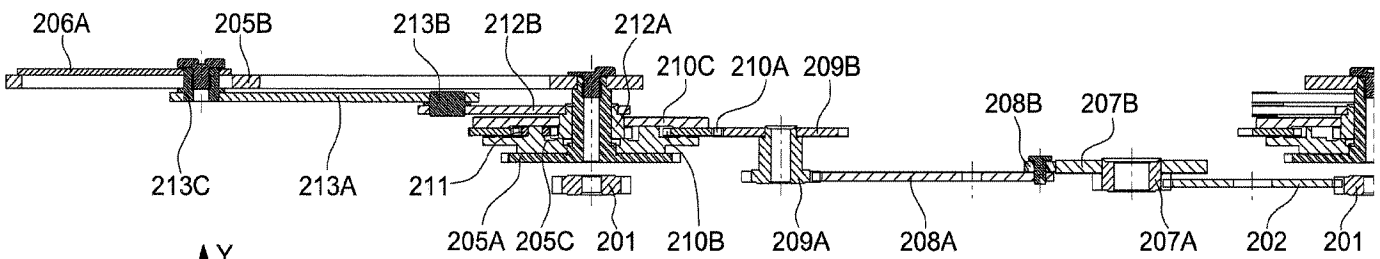

FIGS. 21 to 23 illustrate a display of the type with an articulated arm. Components similar to those of the embodiments of FIGS. 1 to 17 bear the same numeral, added to the value 200.

It is possible to control the two differential inputs by cams thus making it possible to control the elongation via input 110A, and the forward—or backward—motion of the hand via input 105A. In the example of FIG. 21, the end of the hand follows the hand travel PA in the clockwise direction.

Figure 24:
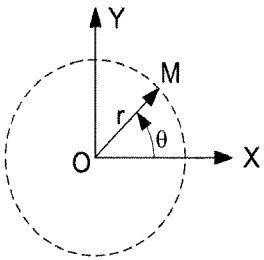
FIG. 24 illustrates the control of the tip of the hand by its polar coordinates.

As seen in FIG. 24, the tip of the hand can be symbolised by a point M of polar coordinates r et θ, where r is controlled by cam 107B, and where angle θ is controlled by cam 103B.

In short, the hand can follow any path in one plane: a figure of eight, a semi-circle, a crescent moon, or other, controlled by two cams configured according to the desired path.

It becomes evident that the mechanism is no longer limited to original display of the time, but to the control of an articulation that also permits animation, such as, for example, the writing of a brand name by a stylus, or the drawing of a symbol on a dial.

The invention also concerns a timepiece movement 100 including at least one such display mechanism 1 driven by an output 101 or similar.

The invention concerns a watch 200 including such a timepiece movement 100 and/or including at least one such display mechanism 1.

The advantage of a retractable display member according to the invention is that it allows a wide variety of displays, with particular trajectories, in particular areas of the watch dial.

In the preferred retrograde type display, the rack of the retrograde mechanism is used for controlling both the angular orientation and the radial extension of the hand. This rack moves in a reciprocating motion. The only continuous driving is that of the snail cam, it is therefore unnecessary to have continuous driving by the centre wheel, which facilitates the site topology inside the watch case. The invention allows for adaptation to cases of any shape and dimension, especially to oval cases which are appreciated for ladies' watches.

The drivers for the connecting rod and the retrograde hand are coaxial, which ensures perfect positioning of the components.

In the first embodiment, the connecting rod pivots directly on the bridge, via ball bearings, or jewelling, or other, with free sizing, not limited by the size of the moving components. The first rack can be detached from the cam feeler member to adjust the initial retrograde position. If the connecting rod pivot is made on a movable bridge, not illustrated by the Figures, it is also possible to adjust the initial elongation of the hand. The small number of pivoting components minimises any residual play. The existence of a single play take-up rack makes it possible to coerce the entire mechanism, and to limit the sensitivity of the hand to shocks, in particular to limit its vibration. The limited number of superposed components permits a low total thickness of the display mechanism.

In the second embodiment, the drivers for the connecting rod and the retrograde hand are coaxial, which also ensures perfect positioning of the components. Each of the two racks controls a particular motion of the hand: the first rack controls rotation, and the second rack controls translational motion. It is thus possible and easy, owing to the cams, to adjust the initial position and elongation of the hand, unlike retrograde displays of the prior art, where indexing of the display occurs during the hand setting operation, via a single difficult manipulation. The rotational driving of the connecting rod provides an additional parameter for the elongation dimensions of the hand. The play take-up racks acting on the first angular orientation wheel and the second elongation wheel make it possible to constrain the hand, and greatly limit the vibration of the hand during shocks.

In each of the embodiments of the invention, the high inertia of the hand during its return to position can be used to drive a disc on a jumper spring. For example, this hand displays the minute, and the hour is displayed on a jumping disc. Upon the return of the minute hand, the latter strikes an hour driver which makes the hours jump, the inertia of the minute hand aiding the hour jump, which thus makes it possible, and greatly facilitates, the synchronization of the jumps of the displays.

The retractable and retrograde display of the invention is modular.

It is also noted that the connecting rod/crank system makes it possible to dispense with milled cam paths in a bridge or plate, and thus the known problems of burrs or milling precision.

What is claimed is:

1. A timepiece display mechanism comprising, arranged on a bridge:

a cam to be driven by a time base, and a lever pivoting about a lever axis and including at a first end, a feeler member following the contour of said cam under the action of an elastic return and at a second end, a first rack meshing with a first angular orientation wheel for the rotational driving thereof about a first axis, said first angular orientation wheel driving an indicator plate synchronously or via a differential mechanism, said indicator plate projecting radially with respect to a main axis and being parallel to or coplanar with said first wheel, wherein said display mechanism includes a connecting rod articulated at a first end to a carriage mounted to slide on said indicator plate and carrying a retractable hand, a second end of said connecting rod being pivoted, either on a fixed pivot on said bridge, or on a movable pivot comprised in an elongation wheel set directly or indirectly driven by said lever.

2. The display mechanism according to claim 1, wherein said first angular orientation wheel synchronously drives said indicator plate, directly or via a gear train, and wherein said second end of said connecting rod is pivoted on said fixed pivot on said bridge.

3. The display mechanism according to claim 1, wherein said first angular orientation wheel synchronously drives said indicator plate directly or via a gear train, and wherein said lever carries, parallel to said first rack, a second rack meshing with a second elongation wheel synchronous with a lever element forming said elongation wheel set and carrying a lever pivot forming a movable articulation wheel set for said connecting rod, said second wheel being parallel to or coplanar with said lever element.

4. The display mechanism according to claim 3, wherein said display mechanism is retrograde, and wherein said cam is a snail cam including, on the maximum radius thereof, a beak, the passage of which causes said feeler member to jump back onto the minimum radius of said cam, and wherein said display mechanism includes, pivoted on said bridge, a third rack returned by a primary elastic return and meshing with said first angular orientation wheel to take up play during the retrograde return thereof upon said jump of said feeler member back onto the minimum radius of said cam, and wherein said display mechanism includes, pivoted on said bridge, a fourth rack returned by a secondary elastic return and meshing with said second elongation wheel to take up play during the retrograde return thereof upon said jump of said feeler member back onto the minimum radius of said cam.

5. The display mechanism according to claim 4, wherein said second elongation wheel pivots about said main axis.

6. The display mechanism according to claim 3, wherein said second elongation wheel pivots about said main axis.

7. The display mechanism according to claim 3, wherein said first rack and said second rack have different radii with respect to said lever axis.

8. The display mechanism according to claim 7, wherein said second rack has a smaller radius than that of said first rack.

9. The display mechanism according to claim 3, wherein said second rack is angularly adjustable, with respect to said lever axis, with respect to said first rack.

10. The display mechanism according to claim 3, wherein said elongation wheel set includes at least a second counterweight arranged to balance, with respect to said main axis, the assembly formed by said lever element with said movable pivot and with said connecting rod.

11. The display mechanism according to claim 1, wherein said first angular orientation wheel drives said indicator plate via said differential mechanism, and wherein said differential mechanism is controlled by a first cam for elongation, and by a second cam for advancement.

12. The display mechanism according to claim 11, wherein said first angular orientation wheel meshes with a first wheel set which forms a first input of said differential mechanism or forms said first wheel set, wherein said display mechanism includes a second wheel set synchronous with said cam and which drives said indicator plate which forms a second input of said differential mechanism, which includes a differential cage forming said elongation wheel set and carrying a cage pivot forming said movable articulation pivot for said connecting rod.

13. The display mechanism according to claim 12, wherein said indicator plate includes at least one planetary pivot carrying a planetary wheel meshing both with said differential cage and said first wheel set.

14. The display mechanism according to claim 1, wherein said display mechanism is retrograde, and wherein said cam is a snail cam including, on the maximum radius thereof, a beak, the passage of which causes said feeler member to jump back onto the minimum radius of said cam, and wherein said display mechanism includes, pivoted on said bridge, a third rack returned by a primary elastic return and meshing with said first angular orientation wheel to take up play during the retrograde return thereof upon said jump of said feeler member back onto the minimum radius of said cam.

15. The display mechanism according to claim 1, wherein said carriage is movable in a radial direction with respect to said main axis.

16. The display mechanism according to claim 1, wherein said indicator plate includes at least a first counterweight, arranged to balance, with respect to said main axis, the assembly formed by said indicator plate with said carriage at the midpoint of the latter's travel, and with said retractable hand.

17. The display mechanism according to claim 1, wherein said first rack is angularly adjustable, with reference to said lever axis, with respect to said feeler member.

18. A timepiece movement including at least one display mechanism according to claim 1.

19. A watch including a timepiece movement according to claim 18.

* * * * *